US008888330B2

(12) United States Patent
Kang et al.

(10) Patent No.: US 8,888,330 B2
(45) Date of Patent: Nov. 18, 2014

(54) OMNIDIRECTIONAL LED LIGHTING APPARATUS

(75) Inventors: Seokhoon Kang, Seoul (KR); Sejoon You, Seoul (KR); Bongho Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 110 days.

(21) Appl. No.: 13/464,291

(22) Filed: May 4, 2012

(65) Prior Publication Data

US 2013/0027928 A1 Jan. 31, 2013

(30) Foreign Application Priority Data

Jul. 25, 2011 (KR) ..... 10-2011-0073585

(51) Int. Cl.

| | |
|---|---|
| ***F21V 7/00*** | (2006.01) |
| ***F21V 29/00*** | (2006.01) |
| ***F21K 99/00*** | (2010.01) |
| *F21Y 105/00* | (2006.01) |

(52) U.S. Cl.

CPC ..... *F21K 9/135* (2013.01); *F21Y 2105/005* (2013.01); *F21K 9/50* (2013.01); *Y10S 362/80* (2013.01)

USPC ..... 362/297; 362/555; 362/800; 362/218; 362/373; 362/514; 362/241; 362/296.01; 362/294

(58) Field of Classification Search

USPC ..... 362/612, 555, 545, 249.02, 311.02, 362/800, 218, 294, 373, 514, 516, 217.05, 362/241, 247, 296.01, 301, 341, 346, 21, 362/7.05, 297; 313/46; 165/185

See application file for complete search history.

(56) References Cited

U.S. PATENT DOCUMENTS

| | | | | |
|---|---|---|---|---|
| 5,806,965 | A * | 9/1998 | Deese | 362/249.04 |
| 6,525,668 | B1 * | 2/2003 | Petrick | 340/815.45 |
| 8,421,321 | B2 * | 4/2013 | Chuang | 313/46 |
| 8,461,748 | B1 * | 6/2013 | Taj | 313/46 |

(Continued)

FOREIGN PATENT DOCUMENTS

| | | | |
|---|---|---|---|
| JP | 2010062005 | A * | 3/2010 |
| JP | 2010086946 | A * | 4/2010 |

(Continued)

OTHER PUBLICATIONS

JP 2010062005 A Machine translation.*

(Continued)

*Primary Examiner* — Nimeshkumar Patel
*Assistant Examiner* — Jose M Diaz
(74) *Attorney, Agent, or Firm* — KED & Associates, LLP

(57) ABSTRACT

A lighting apparatus is disclosed. The lighting apparatus may be an omni-directional LED lamp. The lighting apparatus may include a heat sink and a first substrate disposed over the heat sink. A second substrate may be mounted to a connector provided on the first substrate. The second substrate may include at least one LED mounted on a surface of the second substrate. The second substrate may be mounted in the connector such that the surface of the second substrate is positioned at a prescribed angle with respect to the upper surface of the first substrate. Various types of reflectors are disclosed that reflect light in a prescribed angular range with uniform intensity. A bulb may be provided over the heat sink to surround the LEDs. Moreover, a power module may be electrically connected to the connector to provide power to the LEDs.

16 Claims, 10 Drawing Sheets

(56) References Cited

U.S. PATENT DOCUMENTS

| | | | | |
|---|---|---|---|---|
| 8,540,408 | B2 * | 9/2013 | Takahashi et al. | 362/547 |
| 2004/0195947 | A1 * | 10/2004 | Clark et al. | 313/46 |
| 2012/0081894 | A1 * | 4/2012 | Simon et al. | 362/235 |
| 2012/0112661 | A1 * | 5/2012 | van de Ven et al. | 315/294 |
| 2012/0230028 | A1 * | 9/2012 | Foo | 362/235 |
| 2013/0070458 | A1 * | 3/2013 | Shi | 362/235 |
| 2013/0083526 | A1 * | 4/2013 | Kadoriku et al. | 362/235 |
| 2013/0141905 | A1 * | 6/2013 | Hussell et al. | 362/235 |
| 2013/0193850 | A1 * | 8/2013 | Demuynck et al. | 315/113 |
| 2013/0200300 | A1 * | 8/2013 | Do et al. | 252/75 |
| 2013/0235586 | A1 * | 9/2013 | Gielen et al. | 362/294 |
| 2014/0009936 | A1 * | 1/2014 | Hata et al. | 362/235 |

FOREIGN PATENT DOCUMENTS

| | | |
|---|---|---|
| JP | 3166851 | 3/2011 |
| KR | 10-2010-0044632 A | 4/2010 |
| KR | 10-2010-0089371 A | 8/2010 |

OTHER PUBLICATIONS

JP 2010086946 A Machine translation.*

Korean Notice of Allowance dated Feb. 14, 2013.

* cited by examiner

OMNIDIRECTIONAL LED LIGHTING APPARATUS

CROSS-REFERENCE TO RELATED APPLICATION(S)

This application claims priority under 35 U.S.C. §119 to Korean Application No. 10-2011-0073585 filed in Korea on Jul. 25, 2011, whose entire disclosure(s) is/are hereby incorporated by reference.

BACKGROUND

1. Field

A lighting apparatus is disclosed herein.

2. Background

Lighting apparatuses are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
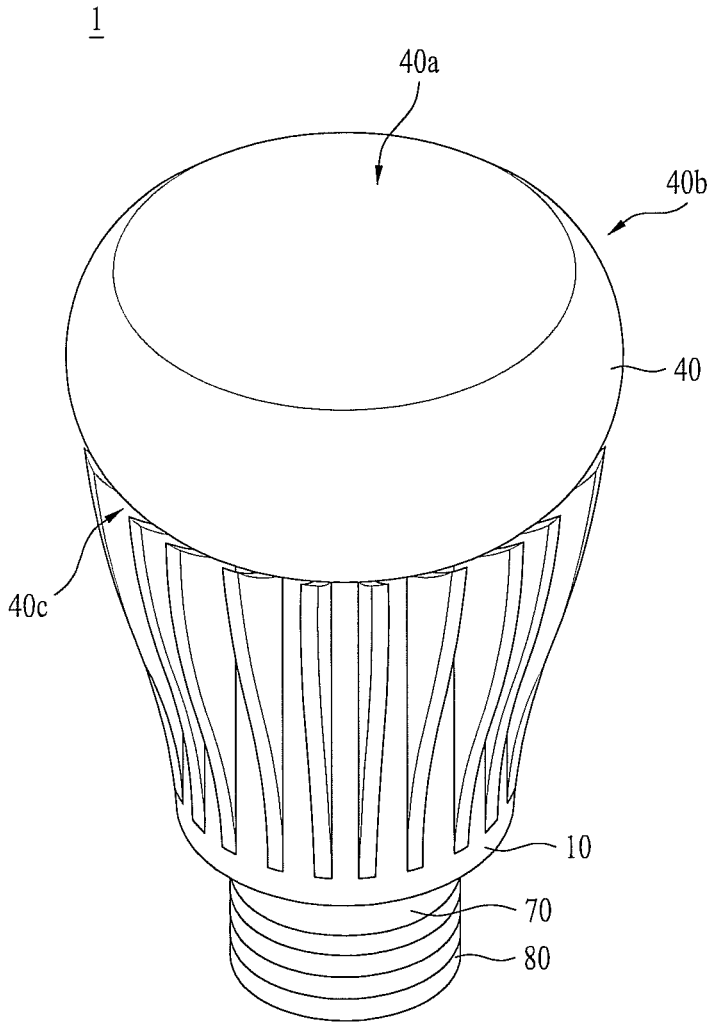
FIG. 1 is a perspective view of a lighting apparatus according to an embodiment of the present disclosure.

Lighting apparatuses may include incandescent bulbs, fluorescent lamps and discharge lamps. These lighting apparatuses may be used for a variety of purposes, such as domestic, industrial, and outdoor purposes. However, lighting apparatuses operating based upon electrical resistance, such as incandescent bulbs, etc., have problems of low efficiency and high heat loss. Discharge lamps are expensive and exhibit relatively poor energy efficiency and fluorescent lamps may be harmful to the environment due to use of mercury.

In contrast, lighting apparatuses which use light emitting diodes (LEDs) may avoid these disadvantages while providing many benefits, such as higher efficiency as well as flexibility in the design of the lighting apparatus (e.g., colors and designs). An LED is a semiconductor device which emits light when a forward voltage is applied thereto. Such an LED exhibits relatively longer lifespans, lower power consumption, and electrical, optical, and physical characteristics suitable for mass production.

However, LEDs generate relatively large amounts of heat. This heat may degrade performance of the lighting apparatus if such heat is not sufficiently dissipated through a heat sink, or the like. Moreover, if the heat generated from the LED is transferred to other constituent elements via the heat sink, the constituent elements may overheat or be damaged. The heat may also deform or otherwise damage the bulb if not sufficiently dissipated and allowed to transfer to the bulb.

Furthermore, LEDs may exhibit degraded light distribution characteristics because of a relatively narrow angular range of light emission, and hence, may not effectively illuminate a large area. For example, a lighting apparatus which employs LEDs may exhibit a high degree of directionality and a narrow radiation angle. For this reason, when an LED based lighting apparatus is installed on a ceiling, for example, only a relatively small region disposed directly beneath the lighting apparatus may be illuminated with sufficient intensity, and areas which are farther away from the light source may not be illuminated with sufficient intensity. Therefore, in order to illuminate a large area with a sufficient intensity of illumination, it may be necessary to increase the number of lighting apparatuses, at the expense of costs in materials and installation.

Accordingly, the present disclosure is directed to a lighting apparatus that substantially obviates one or more problems due to these limitations and disadvantages. As embodied and broadly described herein, a lighting apparatus may be capable of omni-directionally radiating light emitted from an LED while maintaining a uniform level of light intensity. The lighting apparatus may be capable of illuminating a wider area using light emitted from a light emitting diode (LED). The lighting apparatus may reduce the amount of heat transferred from a heat sink to a bulb. Moreover, the lighting apparatus as disclosed herein may allow a reduction in the number of constituent elements, a reduction in manufacturing costs, and be suitable for mass production.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

Reference will now be made in detail to embodiments of the present disclosure associated with a lighting apparatus, examples of which are illustrated in the accompanying drawings. The accompanying drawings illustrate exemplary embodiments of the present disclosure and provide a more detailed description of the present disclosure. However, the scope of the present disclosure should not be limited thereto.

In addition, wherever possible, the same reference numbers will be used throughout the drawings to refer to the same or like parts, and a repeated description thereof will be omitted. For clarity, dimensions and shapes of respective constituent members illustrated in the drawings may be exaggerated or reduced. Moreover, although terms including an ordinal number, such as first or second, may be used to describe a variety of constituent elements, the constituent elements are not limited to the terms, and the terms are used only for the purpose of discriminating one constituent element from other constituent elements.

Moreover, the features lighting apparatus as set forth herein after may be applicable to a bulb type or a flat panel type lighting device. However, simply for ease of description and sake of brevity, the lighting apparatus is described hereafter as a bulb type lighting device, and it should be appreciated that the present disclosure is not limited thereto.

Figure 2:
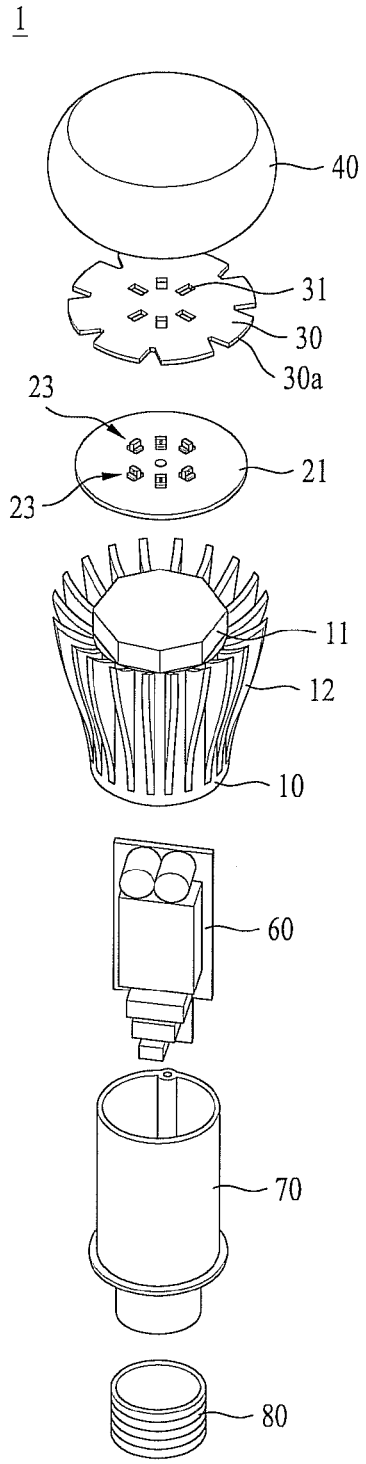
FIG. 2 is an exploded perspective view of the lighting apparatus FIG. 1.

FIG. 1 is a perspective view of a lighting apparatus according to an embodiment of the present disclosure. FIG. 2 is an exploded perspective view of the lighting apparatus of FIG. 1. The lighting apparatus 1 may include an enclosure 40, a light emitting module 20 disposed within the bulb 40, and a heat sink 10 for dissipating heat generated from the light emitting module 20. In addition, the lighting apparatus 1 may include an electronic module 60 electrically connected to the light emitting module 20, a housing 70 that surrounds the electronic module 60, and a power socket 80 mounted to the housing 70.

The enclosure 40 may have various shapes and/or sizes, taking into consideration the functional and aesthetic design of the lighting apparatus 1. For example, the enclosure 40 may be a bulb. Simply for ease of description, the enclosure 40 will be referred to hereinafter as a bulb. The bulb 40 may have a function of diffusing light emitted from the light emitting module 20 or adjusting the radiation direction of the light radiated out through the bulb 40.

For example, where the bulb 40 functions as a diffuser (diffusion member), it may scatter or diffuse light, so that it may be possible to eliminate or substantially reduce the directionality of light. In this case, the bulb 40 may also have a surface structure over the entire surface thereof for diffusing light. The bulb 40 may be mounted to the heat sink 10. For example, the bulb 40 may be fastened to or fitted in the heat sink 10.

The electronic module 60 may convert commercial power into input power compatible with the light emitting module 20. The electronic module 60 may be disposed within the housing 70. The housing 70 may insulate the heat sink 10 and electronic module 60. The power socket 80, which may be mounted to the housing 70, supplies commercial power. The electronic module 60 may include various elements, for example, a AC/DC converter for converting commercial power to DC power, and a transformer for adjusting the voltage level of the DC power.

The heat sink 10 may be made of metal or another suitable material having a high thermal conductivity to rapidly dissipate heat generated from the light emitting module 20. A plurality of heat radiation fins may be provided at the heat sink 10 to increase the contact surface of the heat sink 10 to ambient air. Also, the heat sink 10 may include, at a top portion thereof, with a mounting portion 11 on which the light emitting module 20 is mounted. The mounting portion 11 may be a mounting block or platform that raises a height of the light emitting module 20 on the heat sink 10. The heat sink 10 may include an insertion space formed at an inside region thereof into which the housing 70 is inserted.

Figure 3:
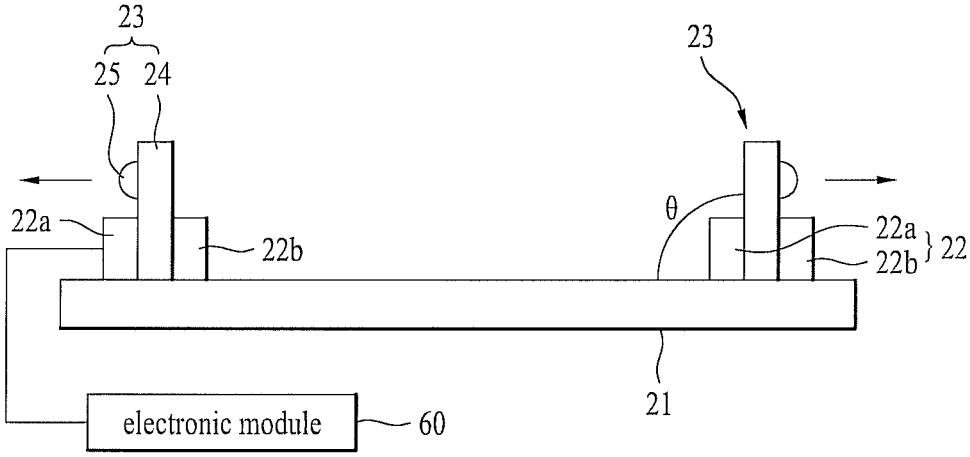
FIG. 3 is a sectional view of a light emitting module of a lighting apparatus according to an embodiment of the present disclosure.
Figure 4:
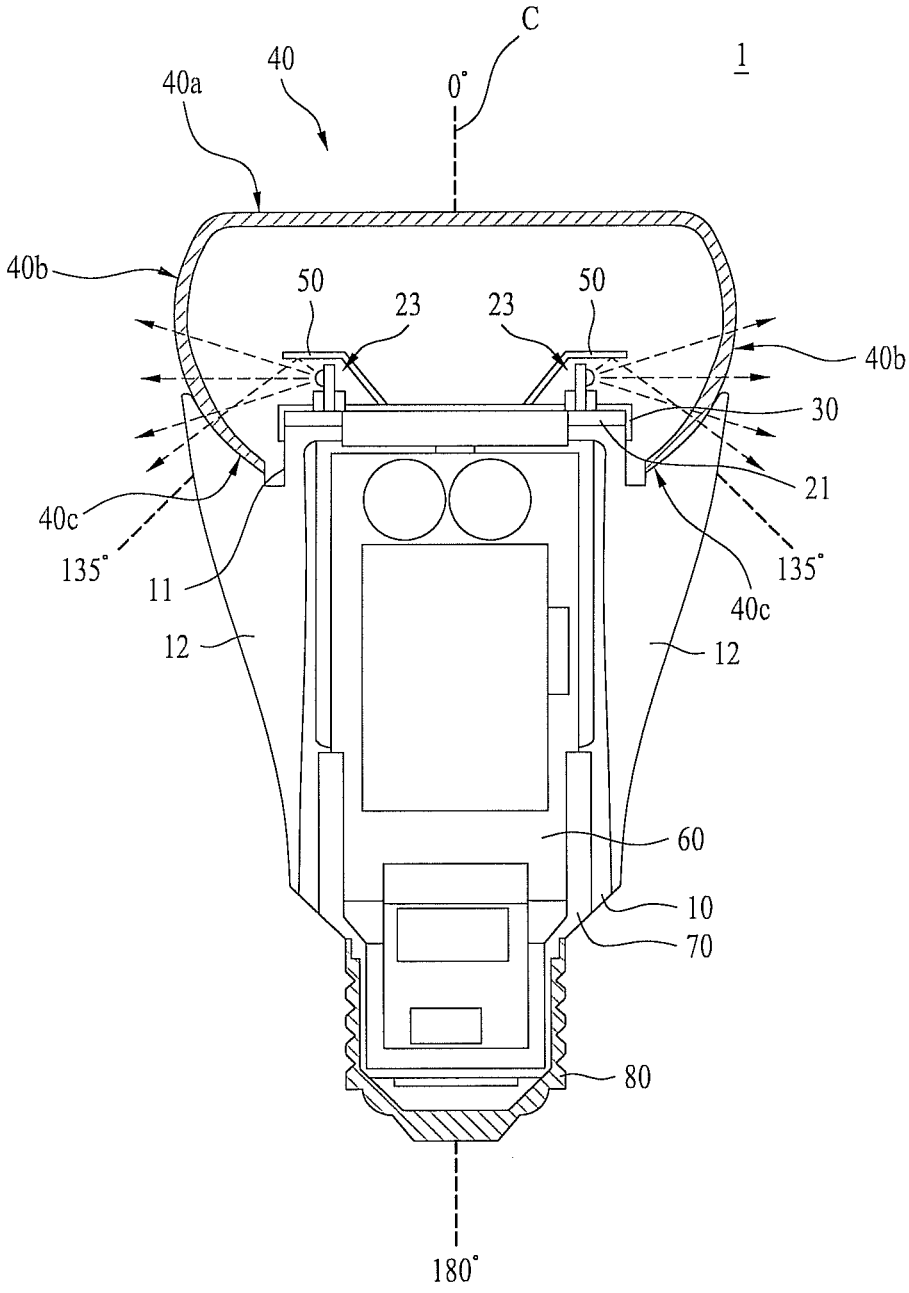
FIG. 4 is a sectional view of a lighting apparatus according to one embodiment of the present disclosure.

FIG. 3 is a sectional view. A light emitting module of the lighting apparatus according to an embodiment of the present disclosure. FIG. 4 is a sectional view of the light emitting module of FIG. 3 in a lighting apparatus according to an embodiment of the present disclosure.

The lighting apparatus 1 may include, in addition to the heat sink 10, a first substrate 21 disposed on the heat sink 10, a connector 22 provided at the first substrate 21, and a light emitting module 23, which includes a second substrate 24 mounted on the connector 22 while being arranged at a predetermined angle θ with reference to the first substrate 21, and an LED 25 provided at the second substrate 24. The lighting apparatus 1 may also include an electronic module 60 that is electrically connected to the light emitting module 23 via the connector 22. The bulb 40 may be disposed on the heat sink 10 while surrounding the LED 25. The LED 25 may include an LED element. Moreover, the lighting apparatus 1 may include a plurality of the light emitting module 23.

The bulb 40 may divided into a central region 40*a*, a side region 40*b*, and a lower end region 40*c* which is mounted to the heat sink 10. The second substrate 24 is arranged at the first substrate 21 such that a maximum-intensity component of light emitted from the LED 25 is directed to the side region 40*b* of the bulb 40.

As described above, the LED 25, which may be an LED device, exhibits a high degree of directionality and a narrow light distribution angle (about 120°). For this reason, when the LED 25 is disposed within the bulb 40, in order to emit light toward the central region 40*a* of the bulb 40, it may be difficult to illuminate a wide area. However, when the LED 25 is disposed within the bulb 40, in order to emit light toward the side region 40*b* of the bulb 40, it may be possible not only to illuminate a wider area, but also to prevent occurrence of a glare phenomenon.

For example, the second substrate 24 may be substantially perpendicularly arranged with reference to the first substrate 21. Of course, the angle of the second substrate 24 with reference to the first substrate 21 may be freely determined, taking into consideration the illumination characteristics of an area where the lighting apparatus 1 is installed.

Hereinafter, a structure for arranging the light emitting module 23 on the first substrate 21 at a predetermined angle and a structure for electrically connecting the light emitting module 23 and the electronic module 60 will be described in detail.

The first substrate 21 may be arranged to be substantially horizontal at the mounting portion 11 of the heat sink 10. For example, the first substrate 21 may be disposed such that a lower surface thereof is in contact with the mounting portion 11. The connector 22 may be provided at an upper surface of the first substrate 21.

The connector 22 not only functions as an angle adjusting member or position adjusting member for arranging the second substrate 24 at a predetermined angle with reference to the first substrate 21, but may also functions to supply power to the light emitting module 23. The connector 22 may includes a pair of terminals 22*a* and 22*b* which are electrically connected to the second substrate 24 to supply power to the LED 25. The second substrate 24 may be interposed between the terminals 22*a* and 22*b*, which have electrodes of different polarities, respectively. The terminals 22*a* and 22*b* may be electrically connected to the electronic module 60. The light emitting module 23 receives power from the electronic module 60 via the connector 22.

The second substrate 24 may be separably fitted in a space defined between the terminals 20*a* and 20*b*. Alternatively, hook structures may be provided at the terminals 20*a* and 20*b* and the second substrate 24. Also, the terminals 20*a* and 20*b* and the second substrate 24 may be fastened at certain regions thereof by separate fastening members such as screws or may be bonded at certain regions thereof.

In order to omni-directionally radiate light using LEDs that face the side region 40 of the bulb, the lighting apparatus 1 may includes a plurality of light emitting modules 23 and a plurality of connectors 22. In this case, the light emitting modules 23 may be radially arranged on the first substrate 21 along a circumferential portion of the first substrate 21. In this case, the connectors 22 may also be radially arranged.

The first substrate 21 may be disposed between the heat sink 10 and the second substrate 24 and may transfer heat generated from the second substrate 24 to the heat sink 10. The first substrate 21 may be made of a metal material having high thermal conductivity. The first substrate 21 may electrically insulate the connector 22 from the heat sink 10. The first substrate 21 may be made of a resin material or composite material having high thermal conductivity and excellent insulation properties.

The lighting apparatus 1 may further include a first reflector 30 (reflection member) which surrounds the first substrate 21. The first reflector 30 may include an edge 30*a* for surrounding the mounting portion 11 of the heat sink 10, and a through hole 31 through which the LED 25 may be exposed (FIG. 2). The edge 30*a* may be a plurality of tabs formed on the outer circumference of the first reflector 30. The tabs may be folded downward against a side surface of the mounting portion 11.

Hereinafter, a procedure for mounting the first reflector 30, which has the above-described structure, will be described. The first substrate 21 is disposed on the mounting portion 11 of the heat sink 10 under the condition that the light emitting module 23 has been mounted on the first substrate 21. The first reflector 30 may then be mounted to surround the first substrate 21 and the mounting portion 11 of the heat sink 10. The light emitting module 23 may be exposed to the interior of the bulb 40 through the through hole 31 of the first reflector 30.

The lighting apparatus 1 may further include a second reflector 50 (reflection member) for reflecting light emitted from the LED 25 toward the heat sink 10. The second reflector 50 may reflect light emitted from the LED 25 toward the heat sink 10, for example, toward the lower end region 40*c* of the bulb 40.

The second reflector 50 may have various shapes. For example, the second reflector 50 may be mounted to the first substrate 21 such that a portion thereof is arranged over the second substrate 24. The second reflector 50 may have a cap shape to surround the light emitting module 23.

For example, a first surface of the second reflector 150 may be placed on a surface of the first reflector 130 or on a surface of the first substrate 121. A second surface of the second reflector 50 may extend at a prescribed angle from the first surface. The angle of the second surface may be determined based on the desired amount of light that is reflected toward the lower end region of the bulb 40. A third surface may extend over the light emitting module 23 from a distal end of the second surface. The third surface may extend a prescribed distance, at a prescribed angle, for the desired amount of light at the lower regions of the lighting apparatus.

Moreover, a portion of the second reflector 50 may contact the second substrate 24. For example, the portion of the second reflector 50 that extends over the second substrate 24 may contact the second substrate 24.

In accordance with the above-described structure, the lighting apparatus 1 may illuminate a wide area because light emitted from the LED 25 may be outwardly radiated through the side region 40*b* and lower end region 40*c* of the bulb 40.

Meanwhile, when luminous flux of at least 5% is secured at a light distribution angle of at least 135°, and an average luminous flux deviation of 20% or less is realized at a light distribution angle ranging from 0° to 135°, an omni-directional light distribution requirement may be satisfied. In the illustrated embodiment, a backward light distribution requirement may be satisfied by reflecting light from the LED LEDs 22 to the side region and lower end region of the bulb 40 by the reflector 30.

Figure 5:
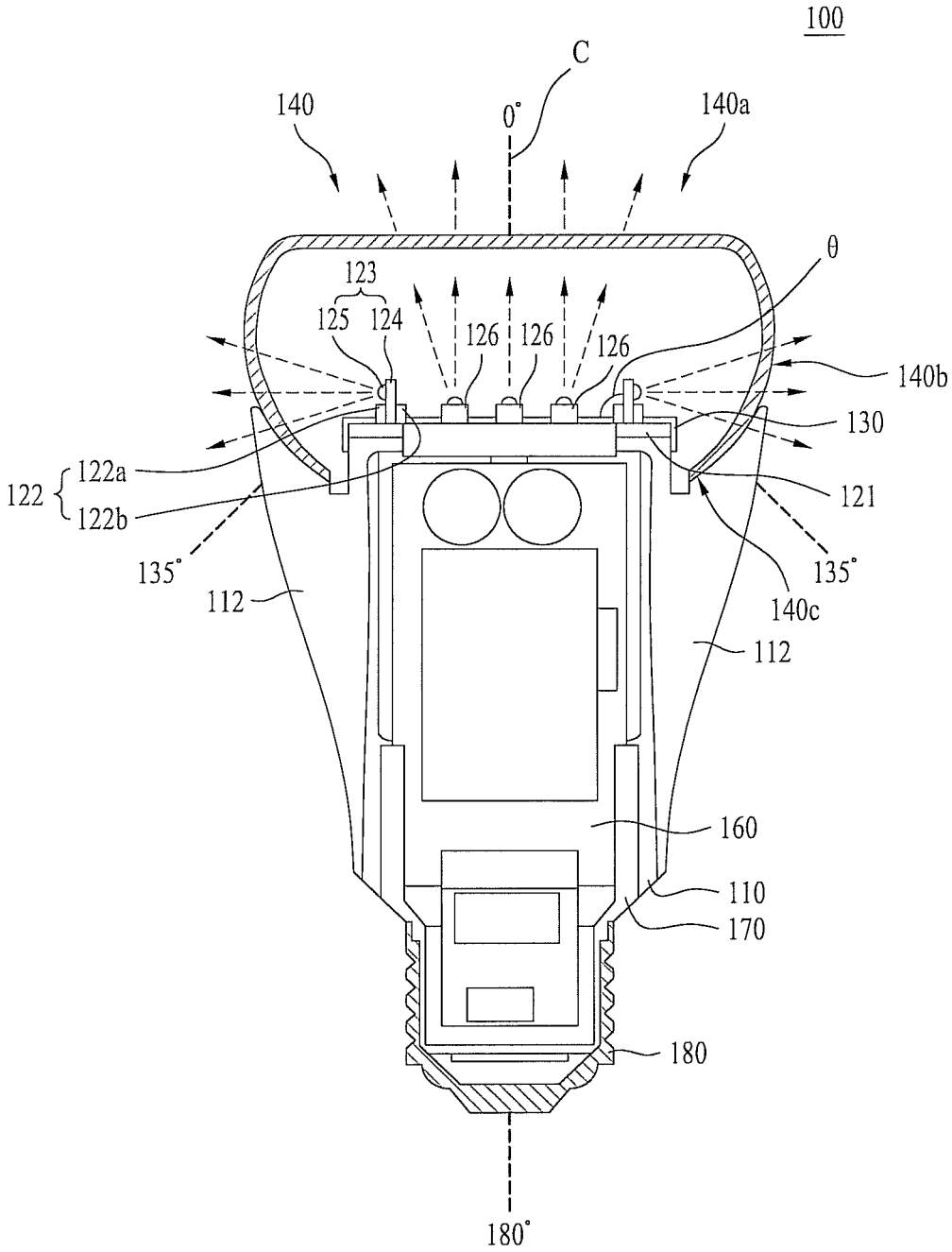
FIG. 5 is a sectional view of a lighting apparatus according to one embodiment of the present disclosure.

FIG. 5 is a sectional view of a lighting apparatus according to another embodiment of the present disclosure. In this embodiment, the lighting apparatus may include LEDs that emit light toward the upper region of the bulb as well as LEDs that emit light toward the side regions of the bulb.

The lighting apparatus 100, may include a heat sink 110, a first substrate 121 disposed on the heat sink 110 and provided with a first LED 126, a connector 122 provided at the first substrate 121, and a light emitting module 123. The light emitting module 123 may include a second LED 125 for emitting light at a predetermined angle with reference to a light emission direction of the first LED 126, and a second substrate 124 mounted on the connector 122 while being arranged at a predetermined angle with reference to the first substrate 121. The second LED 125 may be mounted on the second substrate 124.

The lighting apparatus 100 may include an electronic module 160 electrically connected to the light emitting module 123 through the connector 122, and an enclosure 140 (e.g., bulb) disposed on the heat sink 110 while surrounding the first and second LEDs 126 and 125. The lighting apparatus 1 may include a plurality of first LEDs 126 on the first substrate, a plurality of second substrates 124 and a plurality of light emitting modules 123. Moreover, each light emitting module 123 may include a plurality of second LEDs 125 on the second substrate 124.

The bulb 140 may be divided into a central region 140*a* near the top of the bulb 140, a side region 140*b* around a lateral surfaces of the bulb 140, and a lower end region 140*c* near the bottom of bulb 140 that is mounted to the heat sink 110. The second substrate 124 may be arranged at the first substrate 121 such that a maximum-intensity component of light emitted from the second LED 125 is directed to the side region 140*b* of the bulb 140. The first LED 126 may be arranged at the first substrate 121 such that a maximum-intensity component of light emitted from the first LED 126 is directed to the central region 140*a* of the bulb 140.

Moreover, the number of first LEDs provided to have a vertical light axis and the number of second LEDs provided to have a lateral light axis may be determined based on the amount of light emitted in the angular range of the lighting apparatus. For example, if light intensity at the top of the bulb 140 (e.g., light axis of the lighting apparatus at 0°) is too high relative to other areas (e.g., maximum angular range of omni-directional lighting at 135°), the number of first LEDs may be reduced. The first reflector, the heat sink, etc., may reflect light toward the central region 140*a*, increasing the intensity of light at the central region 140*a*. Hence, it may be desirable to have a smaller number of first LEDs having a vertical light axis relative to the second LEDs having a lateral light axis.

In accordance with the above-described structure, the lighting apparatus 100 may illuminate a wide area because the first and second LEDs 126 and 125 are disposed within the bulb 140 so as to radiate light toward the central region 140*a* as well as the side region 140*b* of the bulb 140.

The second substrate 124 may be arranged substantially perpendicular with respect to the first substrate 121. Of course, the angle θ of the second substrate 124 with respect to the first substrate 121 may be varied, taking into consideration the illumination characteristics of an area where the lighting apparatus 100 is installed.

The structure for arranging the light emitting module 123 on the first substrate 121 at a predetermined angle and the structure for electrically connecting the light emitting module 123 and the electronic module 160 are the same previously described in conjunction with FIGS. 2 and 3. The first substrate 121 may be arranged to be substantially horizontal, e.g., parallel to the top surface of the mounting portion 111 of the heat sink 110.

The connector 122 may includes a pair of terminals 122*a* and 122*b* electrically connected to the second substrate 124 to supply power to the second LED 125. The second substrate 124 may be interposed between the terminals 122*a* and 122*b*. The terminals 122*a* and 122*b* may be electrically connected to the electronic module 160. The light emitting module 123 receives power from the electronic module 160 via the connector 122.

In order to supply power to the first LED 126, the first substrate 121 may be electrically to the electronic module 60. In this case, a heat conduction pad may be interposed between the heat sink 110 and the first substrate 121 in order to obtain enhanced thermal conductivity as well as enhanced electrical insulation properties. When the first LED 121 is a chip-on-substrate (COB) type LED module, the LED module may be mounted on the first substrate 121, and is electrically connected to the electronic module 60 in a direct manner. As described above, the connector 122 not only functions as an angle adjusting member or position adjusting member for arranging the second substrate 124 at a predetermined angle with reference to the first substrate 121, but may also function to supply power to the light emitting module 123.

When the lighting apparatus 100 includes a plurality of light emitting modules 123, the light emitting modules 123 may be radially arranged on the first substrate 121 along a circumferential portion of the first substrate 121. In this case, a plurality of connectors 122 may also be radially arranged.

The lighting apparatus 100 may further include a first reflector 130 (refection member), which surrounds the first substrate 21 while allowing the first LED 126 and second LED 125 to be exposed therethrough. The first reflector 130 (reflection member) is similar to the first reflector 30 of FIGS. 3 and 4. However, in this embodiment, the first reflector 130 may include a separate through hole through which the first LED 126 is exposed to the interior of the bulb 140.

Figure 6:
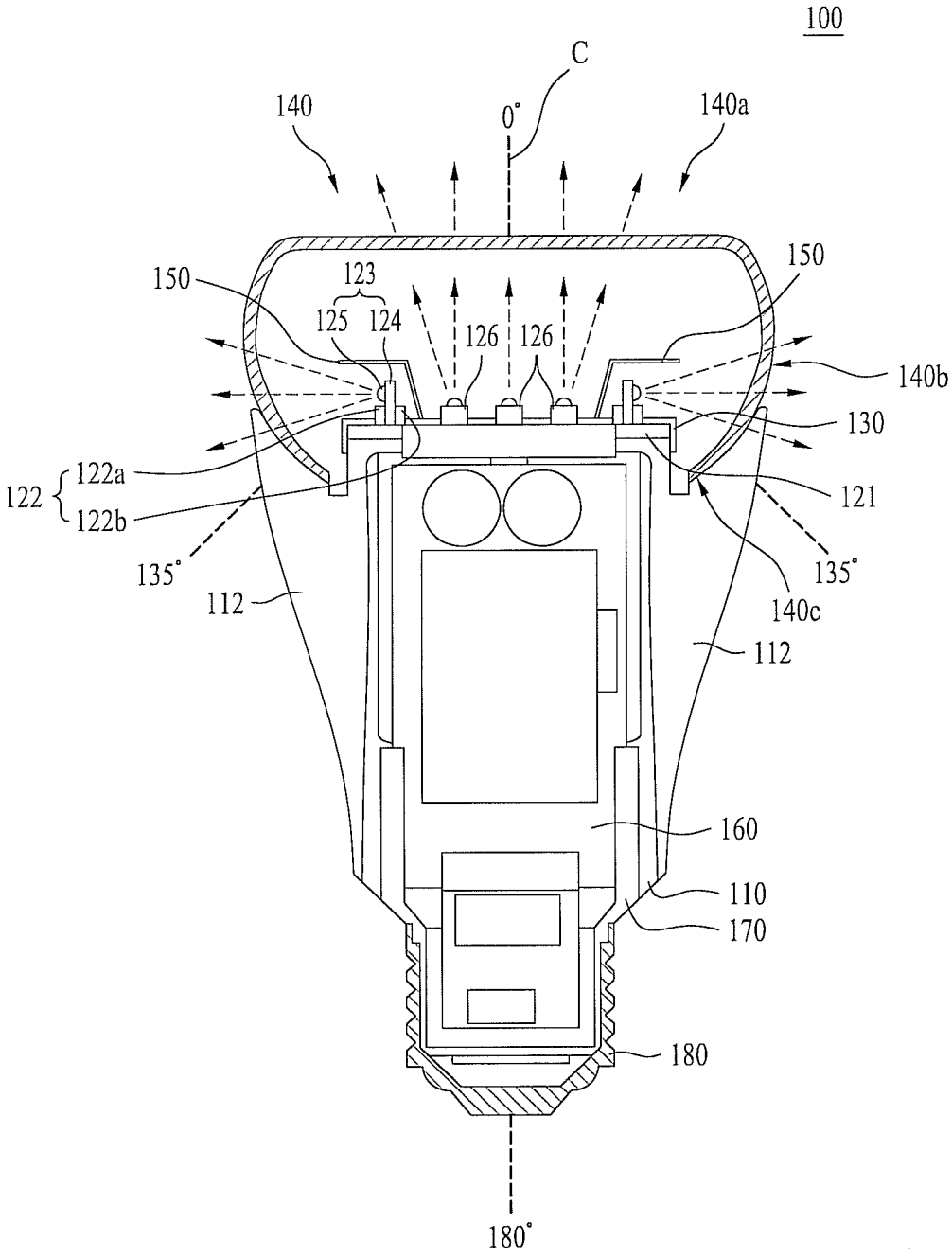
FIG. 6 is a sectional view of a lighting apparatus according to one embodiment of the present disclosure.

FIG. 6 is a sectional view of a lighting apparatus according to one embodiment of the present disclosure. The lighting apparatus 100 may further include a second reflector 150 for reflecting light emitted from the second LED 125 toward the heat sink 110. The second reflector 150 may reflect light emitted from the second LED 125 toward the heat sink 110, for example, toward the lower end region 140*c* of the bulb 140. The second reflector 150 is substantially the same as the second reflector 50 described previously with respect to FIG. 4.

The first and second reflectors 130 and 150 may be integrated with each other. For example, the second reflector 150 may have a portion disposed over the second substrate 124 while having another portion connected to the first reflector 130. A first surface of the second reflector 150 may be placed on a surface of the first reflector 130 or on a surface of the first substrate 121. A second surface of the second reflector 150 may extend at a prescribed angle from the first surface. The angle of the second surface may be determined based on the desired amount of light that is reflected toward the lower end region of the bulb 140. A third surface may extend over the light emitting module 123 from a distal end of the second surface. The third surface may extend a prescribed distance, at a prescribed angle, for the desired amount of light at the lower regions of the lighting apparatus.

Moreover, a portion of the second reflector 150 may contact the second substrate 124. For example, the portion of the second reflector 150 that extends over the second substrate 124 may contact the second substrate 124.

Figure 7A:
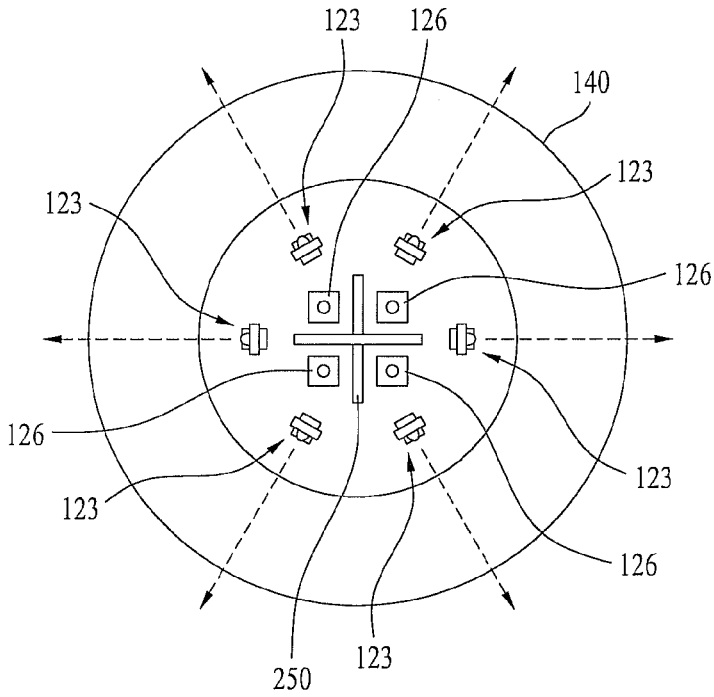
FIG. 7A is a plan view of a lighting apparatus according to one embodiment of the present disclosure.
Figure 7B:
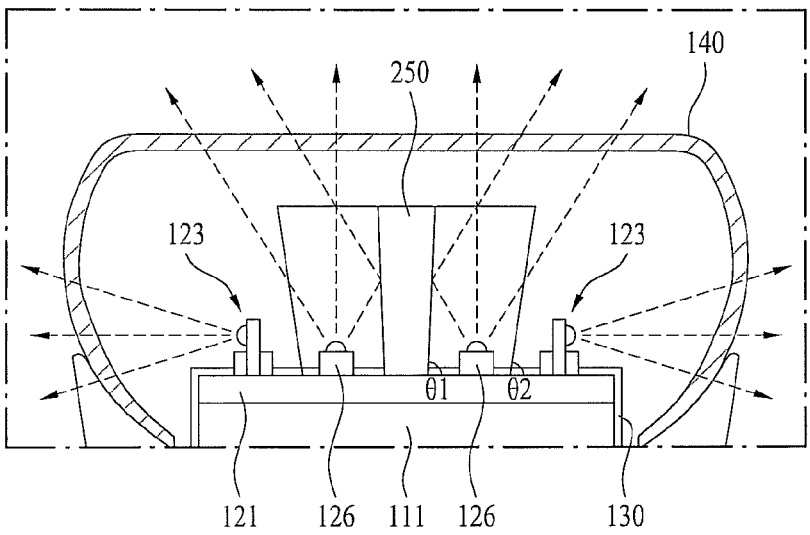
FIG. 7B is a partial sectional view of the lighting apparatus of FIG. 7A.

FIG. 7A is a plan view of a lighting apparatus according to one embodiment and FIG. 7B is a partial sectional view of the lighting apparatus of FIG. 7A. The lighting apparatus 100 may include a reflector 250 that extends vertically from the surface of the first substrate 121. The reflector 250 may have a wall shape and positioned between the second LEDs 126.

The reflector 250 may have side surfaces that are angled at a prescribed angle $\theta_1$ relative to the first substrate 121. The amount of incline of the side surfaces may affect the light intensity at lower end regions 140*c* of the bulb 140 (e.g., illumination in angular range near 135°). The distal end surfaces of the wall may also be inclined at a prescribed angle $\theta_2$, as illustrated in FIG. 7B. The reflector 250 may have a prescribed height based on the desired amount of reflection. It should be appreciated that the side surface of the reflector 250 may be perpendicular to the first substrate 121 (or parallel to the light axis of the first LEDs).

Figure 8A:
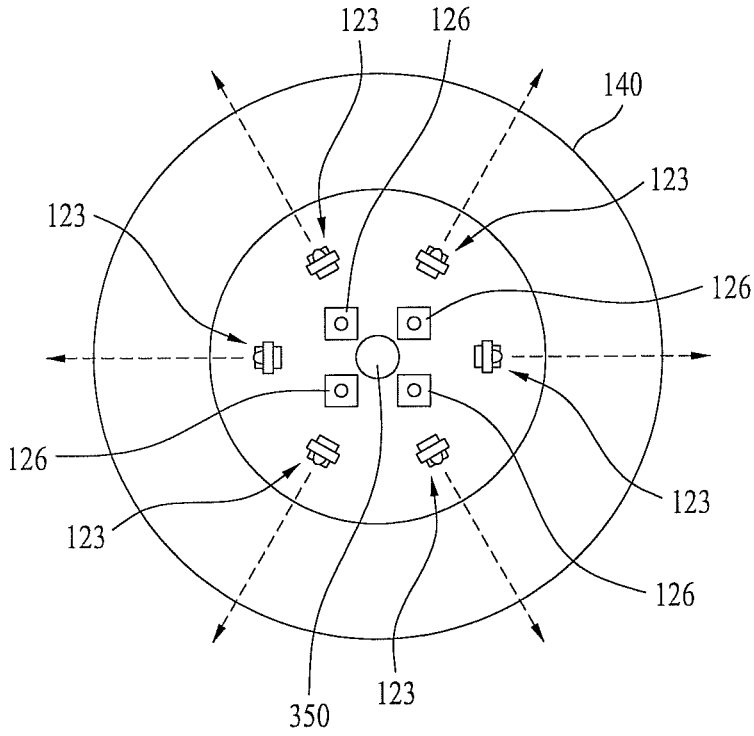
FIG. 8A is a plan view of a lighting apparatus according to one embodiment of the present disclosure.
Figure 8B:
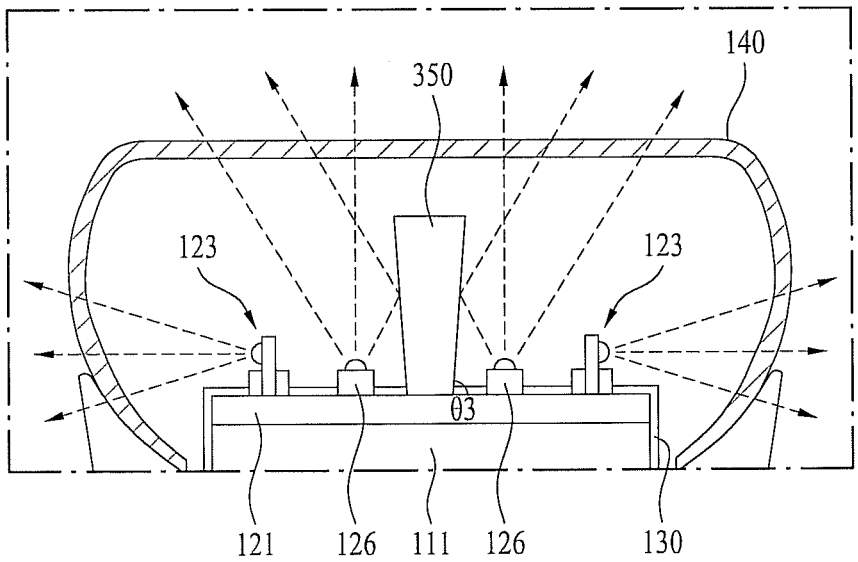
FIG. 8B is a partial sectional view of the lighting apparatus of FIG. 8A.

FIG. 8A is a plan view of a lighting apparatus according to one embodiment of the present disclosure and FIG. 8B is a partial sectional view of the lighting apparatus of FIG. 8A. In this embodiment, the lighting apparatus may include a reflector 350 that has a column shape. The reflector 350 may have a prescribed height and the side surface may be inclined at a prescribed angle $\theta_3$ as illustrated in FIG. 8B.

The reflector 350 may have a round side surface (e.g., a round cross-section) or a polygonal side surface. The diameter and height of the reflector 350 as well as the prescribed angle $\theta_3$ of the side surfaces may be determined based on the desired amount of reflection toward the lower end region 140*c* of the bulb. It should be appreciated that the side surface of the reflector 350 may be perpendicular to the first substrate 121 (or parallel to the light axis of the first LEDs).

The reflector 350 may be positioned between the first LEDs 126. The first LEDs 126 may be arranged radially around the reflector 350. As described previously with respect to other embodiments, a plurality of light emitting modules 123 may be radially positioned around the reflector 350 and the first LEDs 126. The light emitting modules 123 emit light toward a side region 140*b* of the bulb 140 while the first LEDs 126 emit light toward an upper region 140*a* of the bulb 140. The reflector 350 reflects a portion of the light emitted toward the lower end region 140*c* of the bulb 140 in order to provide uniform lighting intensity in the angular range for omni-directional light sources.

It should be appreciated that the various types of reflectors 130, 150, 250, 350 as described above may be used alone or in any combination. For example, the lighting apparatus may include the reflector 130 that covers the first substrate and the mounting platform 111, reflector 150 that extends over the light emitting modules 123, as well as reflector 250 that is placed between the first LEDs 126 on the first substrate 121.

Figure 9A:
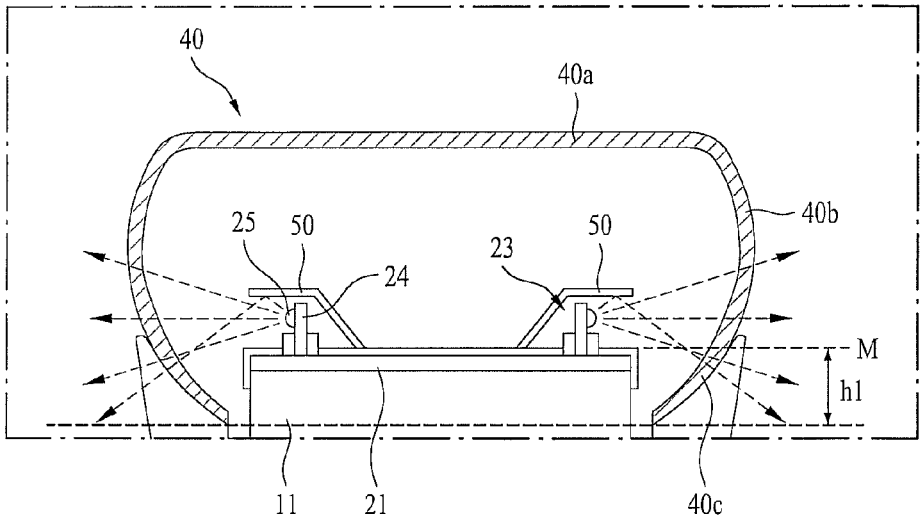
FIGS. 9A and 9B are partial sectional views of a lighting apparatus to illustrate various configurations of the mounting portion.
Figure 9B:
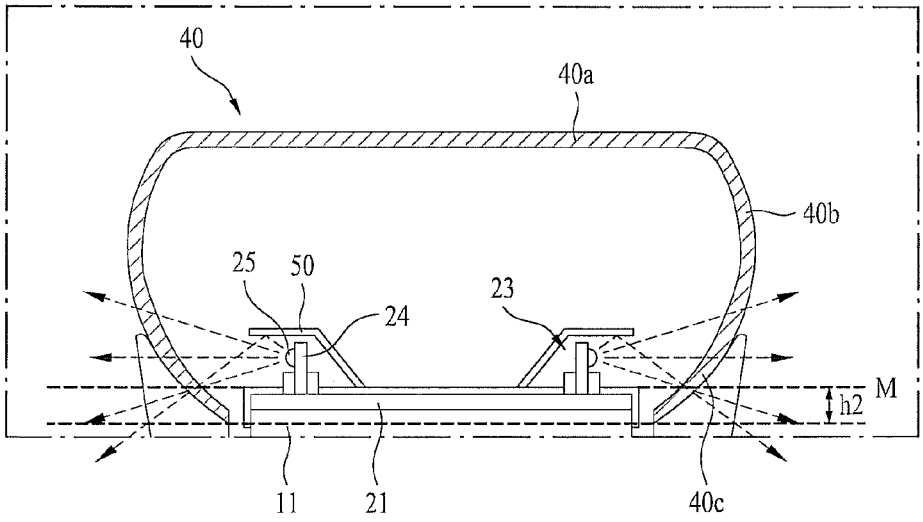
Figure 10A:
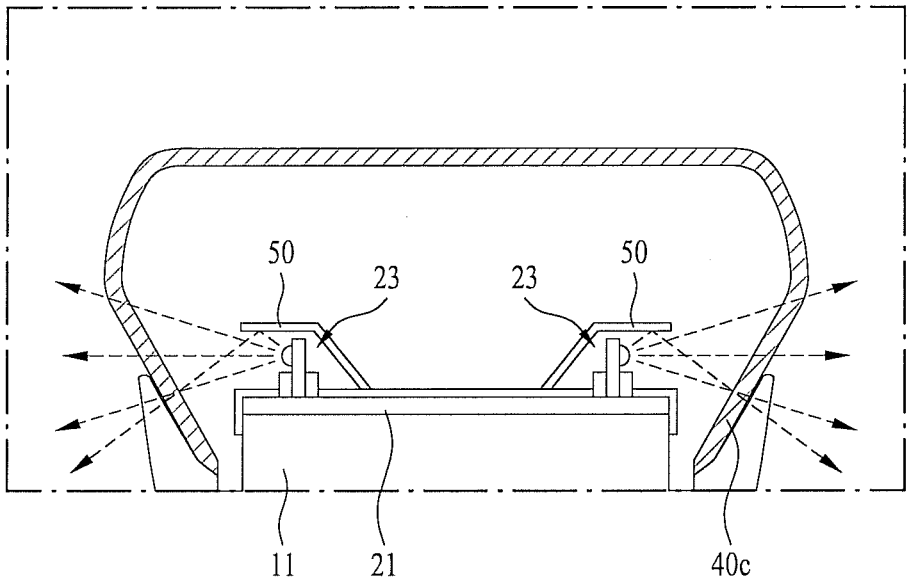
FIGS. 10A and 10B are partial sectional views of a lighting apparatus to illustrate various configurations of the bulb.
Figure 10B:
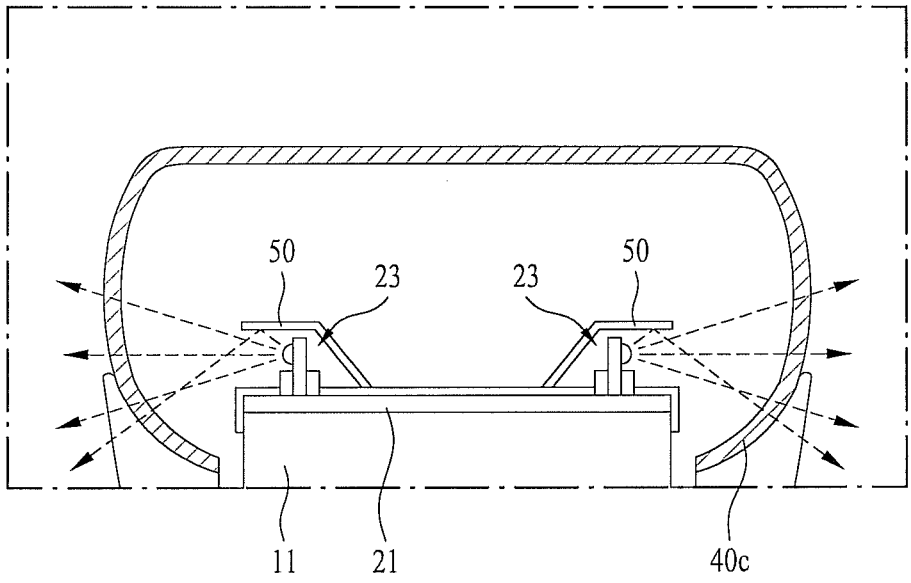

FIGS. 9A and 9B are partial sectional view of a lighting apparatus to illustrate a configuration of the mounting portion 11 and FIGS. 10A and 10B are partial sectional view of the lighting apparatus to illustrate a configuration of the bulb. The various configuration of the mounting portion and the bulb, as illustrated in FIGS. 9 and 10, are applicable to the previously described embodiments. Accordingly, simply for ease of description, the different configurations of the mounting portion and the bulb will be described with reference to the lighting apparatus 1 of FIG. 4.

The mounting portion 11 of the heat sink 10 may protrude above the lower end region 40*c* of the bulb 40 by a predetermined height. The first substrate 21 may be provided on the mounting portion 11 and the first reflector 30 may cover the first substrate 21. In FIGS. 9 and 10, the line M corresponds to the upper surface of the first reflector 30 that is mounted on the mounting portion 11.

Referring to FIG. 9A, the mounting portion 11 may extend a height h1 above the lower edge of the bulb 40. Alternatively, referring to FIG. 9B, the top surface of the first reflector 30 may be positioned lower toward the heat sink 10, at height h2 as illustrated. In other words, the height of the mounting portion 11 may be such that the bottom edge of the first reflector 30 is positioned at the height of the lower end region 40*c* of the bulb 40.

When the mounting portion 11 of the heat sink 10 protrudes above the lower end region 40*c* of the bulb 40 by the predetermined height h1, the LED 25 may also be raised above the lower end region 40*c* of the bulb 40 by the predetermined height h1. In this case, the lighting apparatus 1 may have enhanced backward light distribution characteristics because the effective size of the lower end region 40*c* of the bulb 40 may be widened by the predetermined height.

Referring to FIG. 10A, the lower end region 40*c* of the bulb 40 may include an inclined surface having a diameter that decreases linearly as it extends away from the light emitting module 23 (e.g., toward the heat sink). In other words, the lower end region 40*c* may be formed to be vertically linear. Alternatively, as shown in FIG. 10B, the lower end region 40*c* may have a curved surface having a predetermined curvature. The different configuration of the shape of the bulb 40 at the lower end region 40*c* may vary the scattering characteristics of light passing through the lower end region 40*c*. Accordingly, a desired one of the above-described structure may be appropriately selected in accordance with the characteristics of the area to be illuminated.

As broadly described herein, a lighting apparatus according to each embodiment of the present disclosure may radiate light emitted from the LEDs in a uniform amount over an omni-directional region of the bulb. Also, the lighting apparatus according to each embodiment of the present disclosure may maintain a wide illumination region at a uniform intensity of illumination. In addition, the lighting apparatus according to each embodiment of the present disclosure may achieve a reduction in the number of constituent elements, a reduction in manufacturing costs, and ease of mass production.

To achieve these objects and other advantages and in accordance with the purpose of the disclosure, as embodied and broadly described herein, a lighting apparatus may include a heat sink, a first substrate disposed over the heat sink, a connector provided over an upper surface of the first substrate, a second substrate mounted to the connector and including at least one LED mounted on a surface of the second substrate, a bulb provided over the heat sink to surround the at least one LED, and a power module electrically connected to the connector to provide power to the LED. The second substrate may be mounted in the connector such that the surface of the second substrate is positioned at a prescribed angle with respect to the upper surface of the first substrate.

In one embodiment as broadly described herein, the connector may include at least one terminal that is electrically connected to the second substrate and supplies power to the at least one LED. The second substrate may be mounted between two terminals. The second substrate may be perpendicular with respect to the first substrate. Moreover, the first substrate is made of a metal.

A reflector may be provided over the upper surface of the first substrate and including at least one opening, wherein the first and second LEDs are exposed through the first reflector through the at least one opening. Moreover, a reflector may be over the first substrate and positioned to reflect light from the LED toward the heat sink. The reflector may protrude a predetermined height from the first substrate. A plurality of second LEDs may be positioned radially around the reflector.

The reflector may include a first surface positioned at the upper surface of the first substrate, a second surface that extends from the first surface, and a third surface that extends from the second surface over the second substrate. The second surface of the reflector may be inclined between the first and second surfaces of the reflector. The third surface may be positioned over the second substrate and angled toward the heat sink at a prescribed angle relative a central axis of the heat sink.

The first substrate may include at least one second LED provided on the upper surface of the first substrate and positioned to have a light axis that is substantially perpendicular to the first substrate. A number of LEDs on the second substrate may be greater than a number of second LEDs on the first substrate.

The reflector may protrude a prescribed height perpendicular to the upper surface of the first substrate and is positioned adjacent to the second LED. Moreover, the second reflector may be at least one of a column or wall that protrudes from the upper surface of the first substrate.

The first substrate may be placed on a mounting block on the heat sink and positioned a prescribed height above a lower edge of the bulb that is mounted on the heat sink. Moreover, a lower end region of the bulb near the heat sink may have a radius that decreases linearly toward the heat sink.

In one embodiment as broadly described herein, a lighting apparatus may include a heat sink, a first substrate disposed on the heat sink, and including at least one first LED, a connector provided at the first substrate, a light emitting module including a second substrate and a second LED mounted on the second substrate, an electronic module electrically connected to the light emitting module through the connector, and a bulb provided over the heat sink and surrounds the first and second LEDs. The second substrate may be mounted in the connector and the connector is configured to position the second substrate at an angle with respect to the first substrate, and the second LED may emit light at a predetermined angle with respect to light of the first LED.

In one embodiment as broadly described herein, a lighting apparatus may include a heat sink, a bulb provided over the heat sink, a first substrate provided at a mounting surface on the heat sink, a plurality of second substrates provided radially on the first substrate and extending a prescribed height from the first substrate, at least one LED provided on the second substrates to emit light towards a side region of the bulb, and a reflector provided over the at least one LED and angled toward a lower end region of the bulb mounted on the heat sink.

In one embodiment as broadly described herein, a lighting apparatus may include a heat sink, a first substrate disposed on the heat sink, a connector provided at the first substrate, a light emitting module including a second substrate mounted to the connector while being arranged at a predetermined angle with reference to the first substrate, and a LED provided at the second substrate, an electronic module electrically connected to the light emitting module via the connector, and a bulb provided at the heat sink, to surround the LED.

The connector may include a pair of terminals electrically connected to the second substrate, to supply power to the LED. The second substrate may be interposed between the terminals. The second substrate may be perpendicularly arranged with reference to the first substrate. Moreover, the first substrate may be made of a metal material.

The lighting apparatus may further include a first reflector surrounding the first substrate. The lighting apparatus may further include a second reflector for reflecting light emitted from the LED toward the heat sink. The second reflector may be mounted to the first substrate such that a portion of the second reflector is disposed on the second substrate. The electronic module may be disposed within the heat sink while being electrically connected to the connector.

In another aspect of the present disclosure, a lighting apparatus may include a heat sink, a first substrate disposed on the heat sink, and provided with at least one first LED, a connector provided at the first substrate, a light emitting module including a second LED for emitting light at a predetermined angle with reference to a light emission direction of the first LED, and a second substrate mounted to the connector while being arranged at a predetermined angle with reference to the first substrate, the second LED being disposed on the second substrate, an electronic module electrically connected to the light emitting module via the connector, and a bulb provided at the heat sink, to surround the first and second LEDs.

The connector may include a pair of terminals electrically connected to the second substrate, to supply power to the first and second LEDs. The second substrate may be interposed between the terminals. The second substrate may be perpendicularly arranged with reference to the first substrate.

The lighting apparatus may further include a first reflector surrounding the first substrate while allowing the first and second LEDs to be exposed through the first reflector. The lighting apparatus may further include a second reflector for reflecting light emitted from the first and second LEDs toward the heat sink. The second reflector may have a portion disposed on the second substrate, and another portion connected to the first reflector.

The lighting apparatus may further include a third reflector protruded from the first substrate by a predetermined height. The at least one first LED may include a plurality of first LEDs arranged in a circumferential direction around the third reflector.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a heat sink;

a first substrate disposed over the heat sink;

a connector provided over an upper surface of the first substrate;

a second substrate mounted to the connector and including at least one LED mounted on a surface of the second substrate;

a bulb provided over the heat sink to surround the at least one LED;

a reflector provided over the first substrate and positioned to reflect light from the at least one LED toward the heat sink; and a power module electrically connected to the connector to provide power to the LED, wherein the second substrate is mounted in the connector such that the surface of the second substrate is positioned at a prescribed angle with respect to the upper surface of the first substrate, and wherein the reflector includes a first surface positioned at the upper surface of the first substrate, a second surface that extends from the first surface, and a third surface that extends from the second surface over the second substrate.

2. The lighting apparatus of claim 1, wherein the connector includes at least one terminal that is electrically connected to the second substrate and supplies power to the at least one LED.

3. The lighting apparatus of claim 2, wherein the second substrate is mounted between two terminals.

4. The lighting apparatus of claim 3, wherein the second substrate is perpendicular with respect to the first substrate.

5. The lighting apparatus of claim 2, wherein the first substrate is made of a metal.

6. The lighting apparatus of claim 1, wherein the reflector protrudes a predetermined height from the first substrate.

7. The lighting apparatus of claim 6, wherein a plurality of second LEDs are positioned radially around the reflector.

8. The lighting apparatus of claim 1, wherein the second surface of the reflector is inclined between the first and third surfaces of the reflector.

9. The lighting apparatus of claim 1, wherein the third surface is positioned over the second substrate and angled toward the heat sink at a prescribed angle relative a central axis of the heat sink.

10. The lighting apparatus of claim 1, wherein the first substrate includes at least one second LED provided on the upper surface of the first substrate and positioned to have a light axis that is substantially perpendicular to the first substrate.

11. The lighting apparatus of claim 10, wherein a number of the LEDs on the second substrate is greater than a number of second LEDs on the first substrate.

12. The lighting apparatus of claim 11, wherein the reflector protrudes a prescribed height perpendicular to the upper surface of the first substrate and is positioned adjacent to the second LED.

13. The lighting apparatus of claim 1, wherein the reflector is at least one of a column or wall that protrudes from the upper surface of the first substrate.

14. The lighting apparatus of claim 1, wherein the first substrate is placed on a mounting block on the heat sink and positioned a prescribed height above a lower edge of the bulb that is mounted on the heat sink.

15. The lighting apparatus of claim 1, wherein a lower end region of the bulb near the heat sink has a radius that decreases linearly toward the heat sink.

16. A lighting apparatus comprising:

a heat sink;

a first substrate disposed on the heat sink, and including at least one first LED;

a connector provided at the first substrate;

a light emitting module including a second substrate and a second LED mounted on the second substrate;

a reflector provided over the first substrate and positioned to reflect light from the at least one second LED toward the heat sink;

an electronic module electrically connected to the light emitting module through the connector; and a bulb provided over the heat sink and surrounds the first and second LEDs, wherein the second substrate is mounted in the connector and the connector is configured to position the second substrate at an angle with respect to the first substrate, wherein the second LED emits light at a predetermined angle with respect to light of the first LED, and wherein the reflector includes a first surface positioned at the upper surface of the first substrate, a second surface that extends from the first surface, and a third surface that extends from the second surface over the second substrate.

* * * * *